US006125911A

United States Patent [19]

Wüst et al.

[11] Patent Number: 6,125,911

[45] **Date of Patent: *Oct. 3, 2000**

[54] METHOD AND APPARATUS FOR MANUFACTURING DIE-CASTINGS

[75] Inventors: Jürgen Wüst, Erding; Reinhard Winkler, Engen, both of Germany; Miroslaw Plata, Vetroz, Switzerland

[73] Assignee: Alusuisse Bayrisches Druckguss-Werk GmbH & Co. KG, Markt Schwaben, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/895,089

[22] Filed: Jul. 16, 1997

[30] Foreign Application Priority Data

Jul. 17, 1996 [DE] Germany ..... 196 28 870

[51] Int. Cl.[7] ..... B22D 17/14; B22D 17/32

[52] U.S. Cl. ..... 164/4.1; 164/61; 164/65; 164/113; 164/253; 164/305

[58] Field of Search ..... 164/4.1, 457, 61, 164/63, 65, 113, 253, 254, 305

[56] References Cited

U.S. PATENT DOCUMENTS

| | | | |
|---|---|---|---|
| 5,361,826 | 11/1994 | Yamauchi et al. | 164/457 |
| 5,379,826 | 1/1995 | Miwa et al. | 164/4.1 |
| 5,460,218 | 10/1995 | Miwa et al. | 164/61 |

FOREIGN PATENT DOCUMENTS

| | | | |
|---|---|---|---|
| 0599508 | 6/1994 | European Pat. Off. . | |
| 0600324 | 6/1994 | European Pat. Off. . | |
| 3002886 | 9/1989 | Germany . | |
| 4123463 | 1/1993 | Germany . | |
| 4216773 | 11/1993 | Germany . | |
| 4239558 | 5/1994 | Germany . | |
| 3605529 | 11/1995 | Germany . | |
| 62-220264 | 9/1987 | Japan | 164/305 |
| 63-132760 | 6/1988 | Japan | 164/113 |
| 63-174772 | 7/1988 | Japan | 164/253 |

OTHER PUBLICATIONS

Abstract of Japanese Patent Publication 7–068365 Published Mar. 14, 1995.

*Primary Examiner*—J. Reed Batten, Jr.
*Attorney, Agent, or Firm*—Weingarten, Schurgin, Gagnebin & Hayes LLP

[57] ABSTRACT

The apparatus includes a diecasting mold and evacuation elements for the controlled evacuation of a mold cavity. The evacuation elements includes a vacuum tank and a suction line interconnecting the vacuum tank and the diecasting mold. the suction line includes a first valve and a second valve which is coupled in parallel to the first valve. The valves are arranged so that a reference space is formed therebetween. The method for manufacturing die-castings includes evacuating a diecasting mold, filling the diecasting mold with casting material, removing the die-casting, forming a reference space in a portion of the suction line by closing the two valves which are coupled in parallel, measuring moisture, and pressure and temperature in the reference space, and controlling the apparatus in accordance with the measured values.

14 Claims, 4 Drawing Sheets

METHOD AND APPARATUS FOR MANUFACTURING DIE-CASTINGS

FIELD OF THE INVENTION

The present invention relates to an apparatus for manufacturing die-castings which comprises a diecasting mold as well as evacuation means for the controlled evacuation of a mold cavity, said evacuation means consisting of a vacuum tank and a suction line connecting said vacuum tank and said diecasting mold, which suction line includes a first valve. The present invention further relates to a method for manufacturing die-castings.

BACKGROUND OF THE INVENTION

A generic type of apparatus for manufacturing die-castings is disclosed in German patent DE 30 02 886 C2. In this apparatus, as in other prior art diecasting machines equipped with evacuation means for evacuating the casting molds, filling the mold with molten metal for the last time takes place within a few milliseconds and simultaneously with the evacuation of said mold. The aim here is to obtain a vacuum as high as possible in the mold cavity of the diecasting mold so as to ensure that the finished die-casting is of maximum quality.

European patent no. 0 600 324 A1 describes a method for generating a vacuum in a vacuum diecasting machine in which the vacuum to be generated in the diecasting mold may be controlled during the actual casting process. The march of the pressure of the vacuum generated is controlled via a vacuum valve such that the pressure in the mold cavity, in the casting chamber and in the suction tube is controlled according to a certain variable function per unit of time. The negative pressure is detected via a vacuum measuring probe which measures the pressure in a vacuum connection line.

A pressure diecasting method, however, also requires the use of separating agents and lubricants. The primary task of such additives is to provide a separating layer between the molten metal and the contours of the casting mold, thus preventing the metal from adhering to the casting mold. This happens especially in the case of aluminum diecasting due to the high affinity of the aluminum for the iron of the casting mold. Conventionally, water-mixable separating agents are used for generating said separating layer. These separating agents additionally have a cooling or tempering effect on the diecasting mold.

However, a disadvantage inherent to these prior art methods or apparatuses is that, once the die-cast part has been removed from the mold, the separating agent(s) will have to be deposited anew and that, when the diecasting mold is blown dry, some residual moisture will remain in the mold cavity. While it is possible to suck off a certain percentage of this residual moisture, together with other gases generated during casting, from the mold cavity in the evacuation step, some residual moisture will always remain in the diecasting mold. In a subsequent casting step, however, such residual moisture in the diecasting mold will react adversely with the molten metal, thereby again generating gases. The formation of gases in turn will result in the finished die-casting to be porous or in blowholes or bubbles to be present therein. This will considerably diminish the quality of the finished diecasting.

SUMMARY OF THE INVENTION

It is the object of the present invention to provide a generic apparatus for manufacturing die-castings in which the residual moisture in the diecasting mold is determined and adjusted to a minimum.

The invention is further aimed at providing a generic method allowing the residual moisture remaining in the diecasting mold to be determined and adjusted.

As a novel feature, the apparatus for manufacturing die-castings according to the invention has been equipped with two valves mounted in a suction line. Via these two valves, which are coupled in parallel, a vacuum tank and a diecasting mold may be connected with or disconnected from each other. Closing the two valves will result in a so called reference space to be formed in the suction line. Said reference space will provide an indication of the state prevalent when the last evacuation process of the diecasting mold was terminated. This is a simple approach for determining most of the parameters decisive for the quality of the die-castings, such as in particular the residual moisture in the system, and for controlling the apparatus accordingly.

In an advantageous embodiment of the invention, the reference space of the apparatus contains at least one moisture sensor, one pressure sensor and/or one temperature sensor each. It is thereby ensured that—depending on the demands made on the quality of a specific diecasting—the corresponding parameters may be measured in the reference space.

In another advantageous embodiment of the invention a second vacuum sensor is provided at the vacuum tank. Said second vacuum sensor provides information on the quality of the maximum vacuum or negative pressure which can be obtained or reached in the diecasting mold. The correlation of this value with the actual values measured in the diecasting mold or the reference space will allow the ambient conditions for the diecasting operation to be standardized and thus reproduced.

This will ensure that the method can be controlled based on the actual ambient parameters in the diecasting mold and standardized to corresponding optimized ambient parameters. It is thus possible in accordance with the invention to control the casting operation such that the residual moisture measured is at a typical minimum depending on the individual diecasting mold and die-cast part, and the method reaches a stable state. Surprisingly, it has been found that a direct correlation exists between the residual moisture in the diecasting mold or in the reference space on the one hand and the magnitude of the vacuum or negative pressure created therein, on the other hand.

In a further advantageous embodiment of the method according to the invention, the pressure in the vacuum tank is measured continuously or discontinously. Based on these measurements, the magnitude of the maximum vacuum or negative pressure which can be obtained in the entire system can be standardized—which in turn increases the measuring accuracy.

In yet another advantageous embodiment of the method according to the invention, the measurement of step e) is performed in a time period of 10 to 30 seconds. This will make sure that the sensors used are allowed a sufficiently long response time which in turn results in an increased measuring quality and accuracy. Usually the response times of the sensors used are in a range of approx. 15 seconds.

In yet another advantageous embodiment of the method according to the invention, the evacuation of the diecasting mold according to step a) proceeds up to a pressure of less than 50 mbar. This is due to the fact that the quality of the diecasting operation or of the die-cast part produced therein has been found to improve considerably under such pressure conditions in the diecasting mold.

Further objects, features and advantages of the invention will become apparent from the following description of an embodiment illustrated in the drawings.

DETAILED DESCRIPTION

Figure 1:
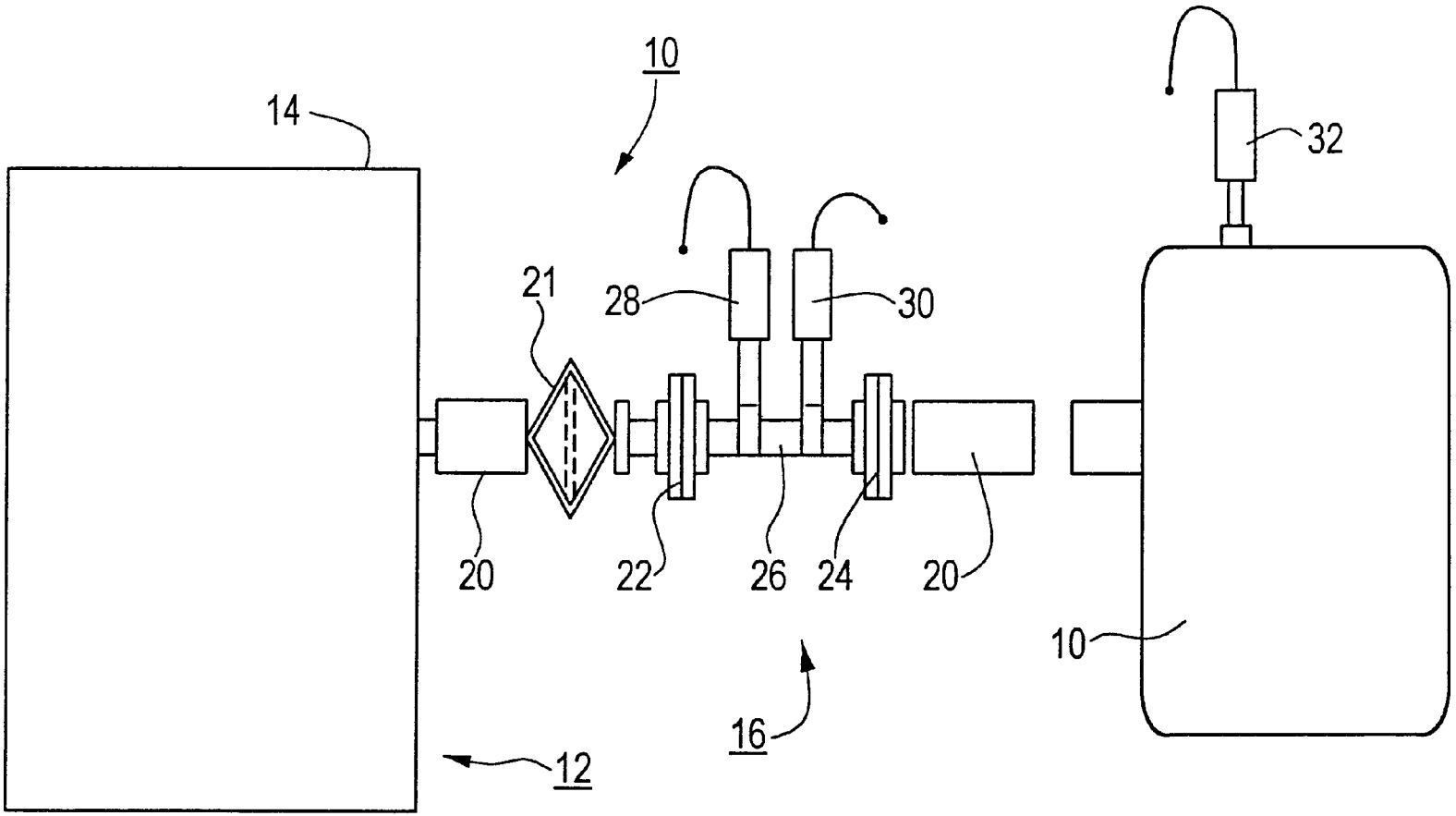
FIG. 1 is a schematical view of an apparatus for manufacturing die-castings according to the invention.

Referring now to FIG. 1, an apparatus 10 for manufacturing die-castings schematically illustrated therein essentially comprises a diecasting mold 12 and evacuation means 16. The diecasting mold 12 in turn comprises a movable mold half 14 and a stationary mold half (not shown). The evacuation means 16 in particular comprises a suction line 20 and a vacuum tank 18 in communication therewith. The end of the suction line opposing said vacuum tank 18 is connected to the movable mold half 14 of said diecasting mold 12.

Two valves 22, 24 coupled in parallel are mounted within said suction line 20. By simultaneously closing said first valve 22 and said second valve 24, a reference space 26 is formed. The two valves 22, 24 may be vacuum valves.

In the embodiment shown, a first pressure, vacuum or temperature sensor 28 and a moisture sensor 30 are arranged so as to protrude into said reference space 26. The reference space 26 reflects the ambient parameters of the state prevalent when the diecasting operation had come to its end and the evacuation of said diecasting mold 12 had been concluded. In order to determine these ambient parameters as precisely as possible, said reference space 26 should expediently be provided as closely as possible to the mold cavity of said diecasting mold 12.

As can further be seen, a second negative pressure or vacuum sensor 32 is provided at said vacuum tank 18. Said second sensor 32 serves for measuring the negative pressure in said vaccum tank 18 which value will render the magnitude of the maximum negative pressure to be obtained and thus also indicate the maximum quality of the vacuum to be obtained in the system. However, a further moisture sensor might also be mounted at said vacuum tank 18 for measuring the relative moisture in said vacuum tank 18, thus providing an indication of the minimum residual moisture which can be achieved in the system.

Mounted between said diecasting mold 12 and said reference space 26 in said suction line is a dirt filter 21. Said filter is especially intended to filter out solids such as metal particles and the like.

All shown sensors 28, 30, 32 are connected to an evaluating unit (not shown). The automatically actuated valves 22, 24 are also connected to this evaluating unit which controls the casting process based on the measuring values obtained.

Figure 2A:
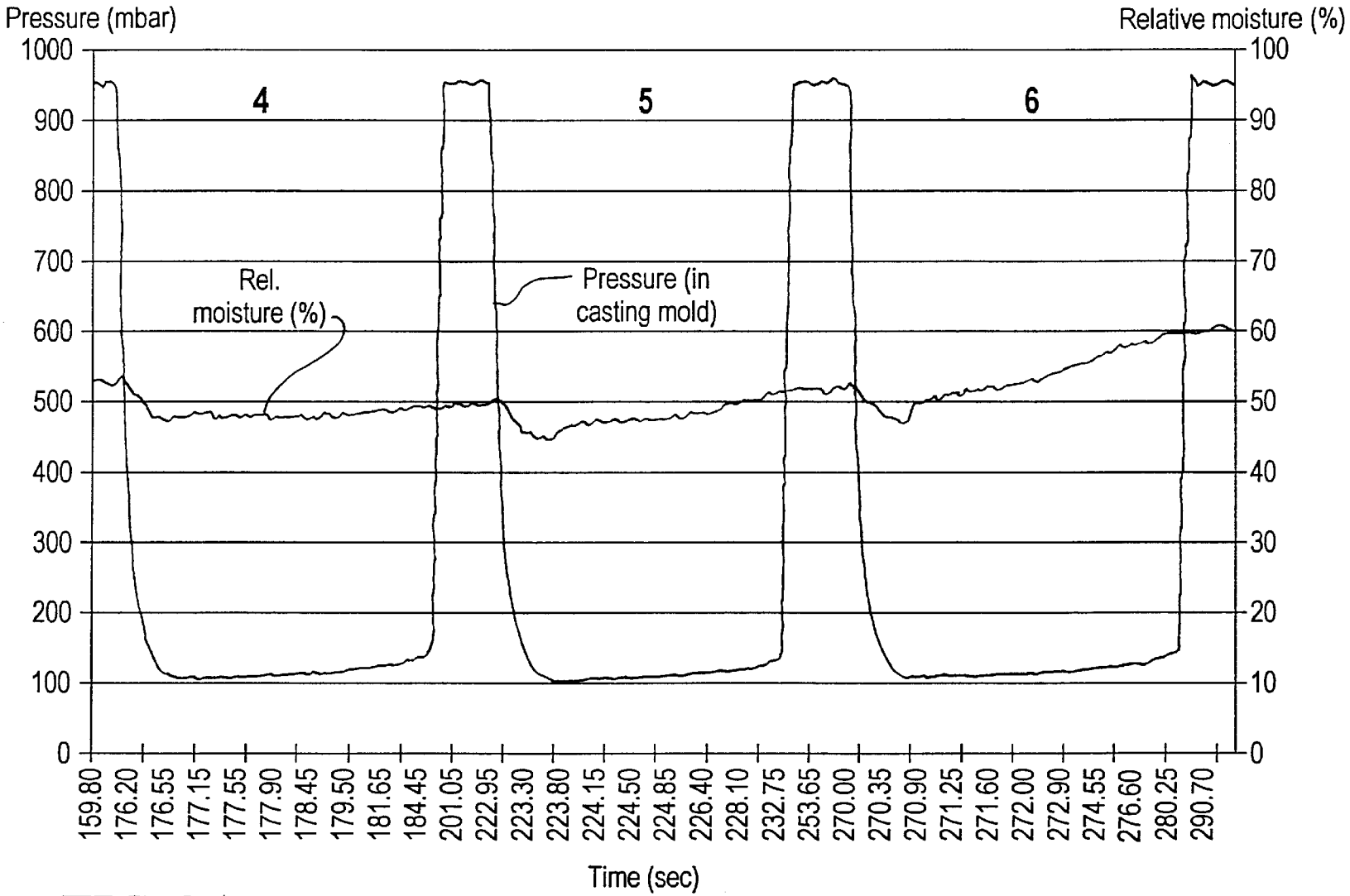
FIGS. 2A and 2B are parameter diagrams illustrating the pressure or the quality of the vacuum and the residual moisture in a diecasting mold or the reference space when the method according to the invention is being performed.
Figure 2B:
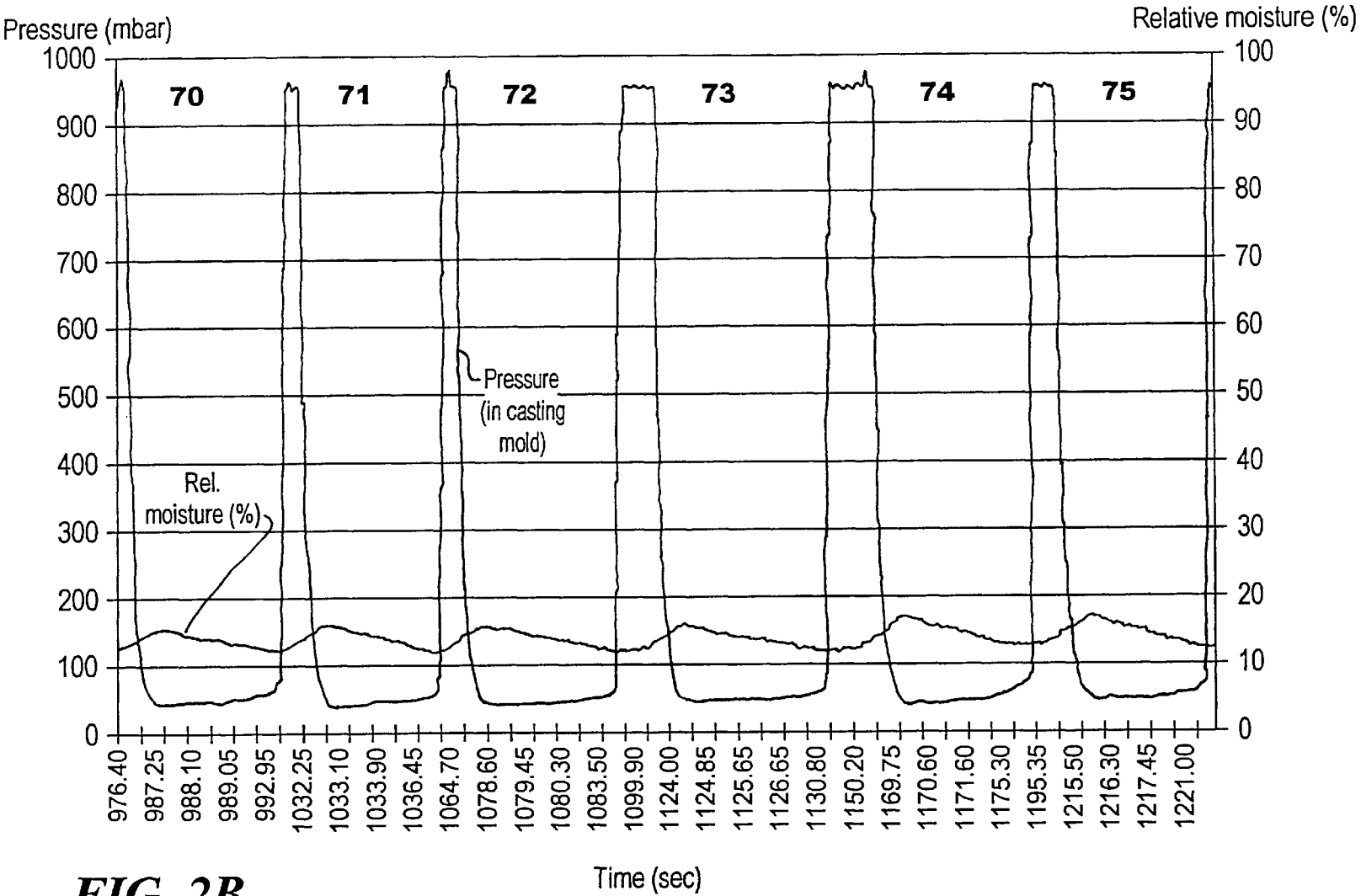

If one compares the process states exemplarily shown in FIGS. 2A and 2B with the parameters pressure and relative residual moisture, it becomes apparent that with a relative residual moisture of between 45 and 60% (measured in reference space 26) a maximum negative pressure of 100 mbar may be reached. FIG. 2A exemplarily illustrates three casting cycles.

By means of the method described, in particular steps d)–f) thereof, it has now become possible to control apparatus 10 such that the relative moisture in the system is reduced to <20%. At the same time, the vacuum or the negative pressure which may be reached is clearly improved, and it is possible to reach a negative pressure of <50 mbar. By improving the quality of the vacuum in the vacuum diecasting method described, the quality of the cast parts is also enhanced which is reflected by the considerably lower percentage of blowholes or bubbles and porosity present in the die-castings. The state parameters according to step e) can be measured continuously or discontinuously.

Owing to the relatively long response times of the sensors 28, 30, 32 provided in the reference space 26, it is useful to keep the reference space 26 closed at least for so long until the respective response time of each of the sensors has been reached. Usually this time is approx. 15 seconds. The measurement of step e) is thus performed in a time range of between 10 to 30 seconds.

In accordance with the method described, it is likewise intended to measure the negative pressure prevailing in vacuum tank 18 continuously or discontinuously. The evacuation of the diecasting mold 12 via the suction line 20 according to step a) proceeds up to a pressure of less than 50 mbar.

By means of the illustrated method, process fluctuations can be readily recognized and taken into account for controlling the apparatus 10. This particularly relates to adjusting the blowing time after the die-cast part has been removed from the diecasting mold 12 as well as adjusting heating or cooling means for controlling the temperature in the system.

The values listed in the following Table clearly show that the pressure conditions in this system may be optimized by reducing the residual moisture measured in the reference space 26, i.e. in the diecasting mold 12.

| Moisture (%) | Pressure (mbar) |
|---|---|
| 36 | 23 |
| 37 | 25 |
| 36 | 20 |
| 16 | 45 |
| 10 | 47 |
| 55 | 110 |
| 20 | 45 |
| 20 | 40 |
| 16 | 45 |
| 27 | 47 |
| 52 | 112 |
| 21 | 45 |
| 36 | 65 |
| 37 | 70 |
| 36 | 68 |
| 20 | 40 |
| 16 | 45 |
| 26 | 47 |
| 25 | 47 |
| 90 | 120 |
| 88 | 105 |
| 94 | 160 |
| 94 | 120 |
| 90 | 90 |

Figure 3:
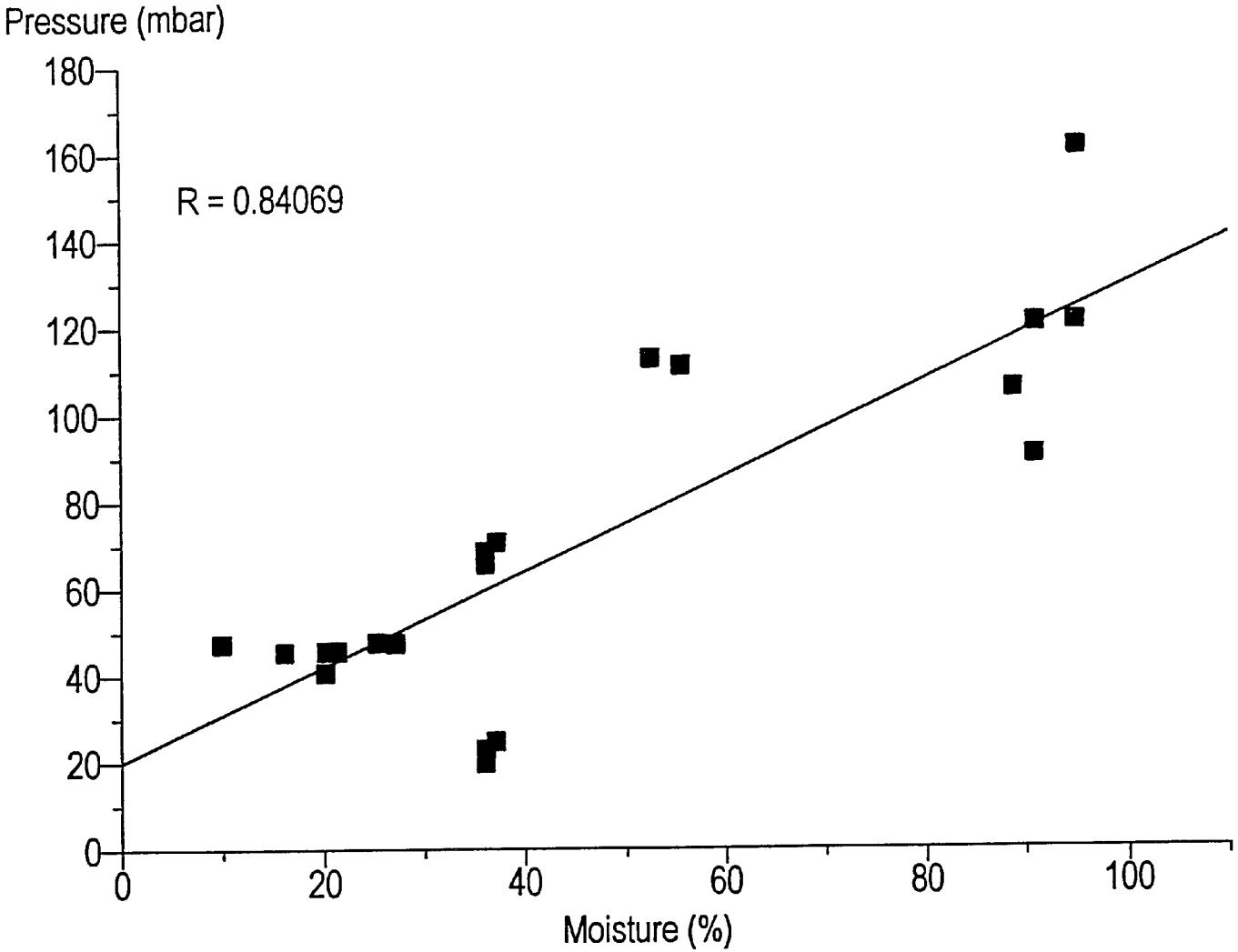
FIG. 3 is a diagram which illustrates the variation of the pressure or the quality of the vacuum in the diecasting mold with the residual moisture in the system.

The values listed in the above Table are also illustrated in the diagram of FIG. 3. One can clearly see the positive correlation (R=0.84069) of the residual moisture as compared to the vacuum or negative pressure to be obtained. An important conclusion as to the quality of the process may be drawn therefrom which leads to a considerably improved quality of the die-castings.

What is claimed is:

1. An apparatus for manufacturing die-castings comprising a diecasting mold having a mold cavity and evacuation means provided for the controlled evacuation of the mold cavity, said evacuation means comprising a vacuum tank and a suction line interconnecting said vacuum tank and said diecasting mold, said suction line including a first valve disposed between said mold cavity and said vacuum tank, a second valve disposed between said first valve and said vacuum and a reference space adapted for sensing formed between said first and second valves and at least one moisture sensor, pressure sensor, and temperature sensor provided in said reference space and a vacuum sensor provided at said vacuum tank.

2. The apparatus of claim 1 wherein said diecasting mold comprises a movable mold half and a stationary mold half.

3. The apparatus of claim 2 wherein said suction line is mounted on said movable mold half.

4. The apparatus of claim 1 wherein said first and second valves are vacuum valves.

5. The apparatus of claim 1 wherein a dirt filter is provided in said suction line between said diecasting mold and said reference space.

6. An apparatus for manufacturing diecastings comprising a diecasting mold having a mold cavity and evacuation means provided for the controlled evacuation of the mold cavity, said evacuation means comprising a vacuum tank and a suction line interconnecting said vacuum tank and said diecasting mold, said suction line including a first valve, wherein a second valve coupled in parallel with said first valve is provided in said suction line so that a reference space is formed between said valves;

wherein at least one moisture sensor and one pressure sensor and one temperature sensor are provided in said reference space;

wherein said diecasting mold comprises a movable mold half and a stationary mold half;

wherein said suction line is mounted on said movable mold half;

wherein a second vacuum sensor is provided at said vacuum tank; and wherein a dirt filter is provided in said suction line between said diecasting mold and said reference space.

7. A method for manufacturing diecastings comprising the following steps:

a) evacuating a diecasting mold;

b) filling said diecasting mold with casting material to form a diecasting;

c) removing said diecasting;

d) forming a reference space in a portion of a suction line which is provided between said diecasting mold and a vacuum tank by closing two valves coupled in parallel;

e) measuring moisture and pressure and temperature in said reference space; and f) controlling manufacturing of said diecastings in accordance with the values measured in step e);

wherein the measurement of step e) is performed over a time range of 10 to 30 seconds; and wherein the evacuation of said diecasting mold according to step a) is performed up to a pressure of less than 50 mbar.

8. A method for manufacturing die-castings comprising the following steps:

a) evacuating a diecasting mold;

b) filling said diecasting mold with casting material to form a die-casting;

c) removing said die-casting;

d) forming a reference space adapted for sensing in a portion of a suction line which is provided between said diecasting mold and a vacuum tank by closing a first valve disposed between a cavity of said mold and said vacuum tank and a second valve disposed between said first valve and said vacuum tank;

e) measuring moisture, pressure, and temperature in said reference space; and f) controlling manufacturing of said die-castings in accordance with the values measured in step e).

9. The method of claim 8 wherein the measurement of step e) is performed continuously.

10. The method of claim 8 wherein pressure in said vacuum tank is measured continuously.

11. The method of claim 8 wherein the measurement of step e) is performed over a time range of 10 to 30 seconds.

12. The method of claim 8 wherein the evacuation of said diecasting mold according to step a) is performed up to a pressure of less than 50 mbar.

13. The method of claim 8 wherein the measurement of step e) is performed discontinuously.

14. The method of claim 8 wherein pressure in said vacuum tank is measured discontinuously.

* * * * *